US008528263B2

(12) United States Patent
Schmidt et al.

(10) Patent No.: US 8,528,263 B2
(45) Date of Patent: Sep. 10, 2013

(54) RAINWATER DIVERTER

(75) Inventors: Matthew L. Schmidt, Avon, OH (US); Robert P. Shade, Warren, OH (US)

(73) Assignee: Oatey Co., Cleveland, OH (US)

( * ) Notice: Subject to any disclaimer, the term of this patent is extended or adjusted under 35 U.S.C. 154(b) by 247 days.

(21) Appl. No.: 12/861,162

(22) Filed: Aug. 23, 2010

(65) Prior Publication Data

US 2011/0041416 A1 Feb. 24, 2011

Related U.S. Application Data

(60) Provisional application No. 61/235,813, filed on Aug. 21, 2009.

(51) Int. Cl.
*E04D 13/08* (2006.01)

(52) U.S. Cl.
USPC ..... 52/16; 52/97; 52/302.3; 137/357

(58) Field of Classification Search
USPC ..... 52/11, 13, 14, 16, 97, 131, 218, 302.3, 52/302.5; 137/873, 357, 561 A
See application file for complete search history.

(56) References Cited

U.S. PATENT DOCUMENTS

| | | | | | |
|---|---|---|---|---|---|
| 1,852,999 | A | * | 4/1932 | Griffith | 137/559 |
| 3,481,366 | A | * | 12/1969 | Mortonson | 137/873 |
| 3,990,474 | A | * | 11/1976 | Harms | 137/873 |
| 4,182,376 | A | | 1/1980 | Nilsson | |
| 4,212,314 | A | * | 7/1980 | Ericson | 137/216.2 |
| 4,386,484 | A | * | 6/1983 | van Berne et al. | 52/16 |
| 4,811,431 | A | * | 3/1989 | Kraverath | 4/679 |
| 5,068,494 | A | * | 11/1991 | Bolante | 174/654 |
| 5,114,594 | A | * | 5/1992 | Rosebrock et al. | 210/767 |
| 5,119,849 | A | * | 6/1992 | Hinkley | 134/104.1 |
| 5,452,546 | A | * | 9/1995 | Goddard | 52/12 |
| 5,533,303 | A | * | 7/1996 | Harvey | 52/16 |
| 5,681,455 | A | * | 10/1997 | Takai et al. | 210/154 |
| 5,730,179 | A | * | 3/1998 | Taylor | 137/357 |
| 6,024,127 | A | * | 2/2000 | Johnson | 137/873 |

(Continued)

FOREIGN PATENT DOCUMENTS

| | | |
|---|---|---|
| EP | 0 901 806 | 3/1999 |
| WO | 2004/065701 | 8/2004 |

OTHER PUBLICATIONS

Rain Reserve literature; © 2007; 4 pages.

(Continued)

*Primary Examiner* — William Gilbert
*Assistant Examiner* — James Ference
(74) *Attorney, Agent, or Firm* — Calfee, Halter & Griswold LLP

(57) ABSTRACT

Rainwater diverter comprises a base member and a sleeve member. The base member includes a tubular conduit having an upper end and a lower end sized to closely fit within an upper end of a lower downspout section. Surrounding the tubular conduit is a fluid chamber having an open upper end and a closed bottom, and a discharge opening adjacent the bottom. The sleeve member has a lower end sized to have a close sliding fit inside the open upper end of the chamber, and an upper end sized to have a close sliding fit over a lower end of an upper downspout section. The sleeve member is shaped to provide a narrow gap between the sleeve member and the upper end of the tubular conduit leading into the chamber surrounding the tubular conduit.

8 Claims, 3 Drawing Sheets

(56) References Cited

U.S. PATENT DOCUMENTS

| | | | | |
|---|---|---|---|---|
| 6,527,005 | B2 * | 3/2003 | Weaver | 137/312 |
| 6,619,312 | B2 * | 9/2003 | Doiron | 137/122 |
| 7,395,633 | B2 * | 7/2008 | Baeta | 52/16 |
| 7,493,728 | B2 | 2/2009 | Dussault et al. | |
| 7,550,077 | B2 * | 6/2009 | Graf | 210/162 |
| 7,775,232 | B2 * | 8/2010 | Takai | 137/122 |
| 7,818,928 | B2 * | 10/2010 | Brunt et al. | 52/218 |
| 7,870,868 | B1 * | 1/2011 | Ilalaole | 137/434 |
| 7,919,002 | B1 * | 4/2011 | Hurtado | 210/747.2 |
| 8,006,720 | B1 * | 8/2011 | Kotansky | 137/873 |
| 8,075,765 | B2 * | 12/2011 | Perlatti | 210/162 |
| 2003/0167700 | A1 * | 9/2003 | Esmond et al. | 52/12 |
| 2005/0246967 | A1 * | 11/2005 | Esmond et al. | 52/16 |
| 2006/0101723 | A1 * | 5/2006 | Baeta | 52/16 |
| 2008/0086953 | A1 * | 4/2008 | Graf | 52/12 |
| 2008/0229673 | A1 * | 9/2008 | LaMorte et al. | 52/12 |
| 2008/0314457 | A1 * | 12/2008 | Platteel | 137/357 |
| 2009/0065072 | A1 * | 3/2009 | Adamson | 137/357 |
| 2010/0193046 | A1 * | 8/2010 | Moroder et al. | 137/357 |
| 2010/0200482 | A1 * | 8/2010 | Perlatti | 210/170.03 |

OTHER PUBLICATIONS

"Rain Reserve Installation Guide"; undated (admitted prior art); 8 pages.

* cited by examiner

RAINWATER DIVERTER

CROSS-REFERENCE TO RELATED APPLICATIONS

This application claims the benefit of U.S. Provisional Application Ser. No. 61/235,813, filed Aug. 21, 2009, the entire disclosure of which is incorporated herein by reference.

FIELD OF THE INVENTION

This invention relates to a rainwater diverter for diverting rainwater flowing through a roof gutter downspout into one or more large tanks or cisterns for storage and later use or directed by a hose for irrigation or other non-potable water needs as desired.

SUMMARY OF THE INVENTION

The rainwater diverter of the present invention includes two main components, a lower base member and an upper sleeve member. The lower base member includes a generally tubular conduit having a lower end that is sized to closely fit within an upper end of a lower downspout section. Surrounding the tubular conduit is an annular chamber that terminates below the upper end of the tubular conduit. Within the annular chamber is an internal stop shoulder that provides a seat for engagement by the lowermost end of the upper sleeve member when inserted into the upper end of the chamber. The upper end of the upper sleeve member is sized to have a close sliding fit over the lower end of the upper downspout section. The inner wall of the upper sleeve member angles outwardly and downwardly adjacent the upper open end of the tubular conduit of the base member when the lowermost end of the sleeve member is fully seated inside the annular chamber to provide a narrow gap leading into the surrounding chamber through which the rainwater flowing through the upper downspout section passes for discharge out a spout adjacent the bottom of the chamber. Most leaves or other debris carried by the rainwater are too large to pass through the gap and will fall down through the open center conduit into the lower downspout section.

These and other objects, advantages, features and aspects of the present invention will become apparent as the following description proceeds.

To the accomplishment of the foregoing and related ends, the invention, then, comprises the features hereinafter more fully described and particularly pointed out in the claims, the following description and annexed drawings setting forth in detail a certain illustrative embodiment of the invention, this being indicative, however, of but one of the various ways in which the principles of the invention may be employed.

DETAILED DESCRIPTION OF THE INVENTION

Figure 1:
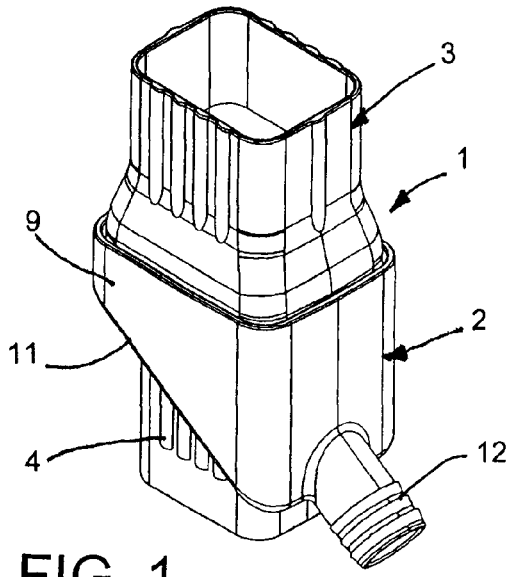
FIG. 1 is a perspective view of one form of rainwater diverter of the present invention.
Figure 2:
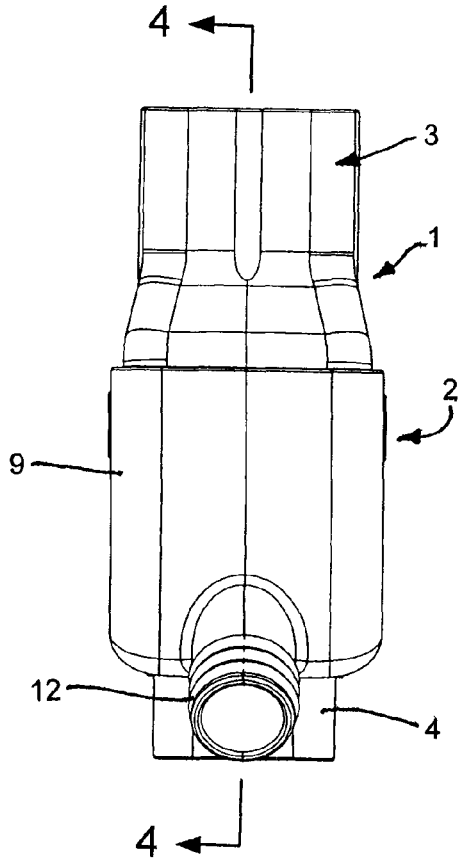
FIG. 2 is a front elevation view of the rainwater diverter of FIG. 1.

Referring to the drawings, there is shown one form of rainwater diverter 1 in accordance with the present invention which is dimensioned to be fitted into a cut out section of an existing roof gutter downspout for diverting rainwater flowing down through the downspout for use for irrigation and other conservational purposes. At the same time, the diverter allows any leaves or other debris that may have washed off the roof into the gutter to fall through the open center of the diverter and out the lower end of the downspout to drain as in a conventional gutter downspout system. The diverted rainwater may be collected in one or more large tanks or cisterns (not shown) for storage for later use for irrigation such as watering gardens, plants and yards or other non-potable water needs as desired.

Figure 4:
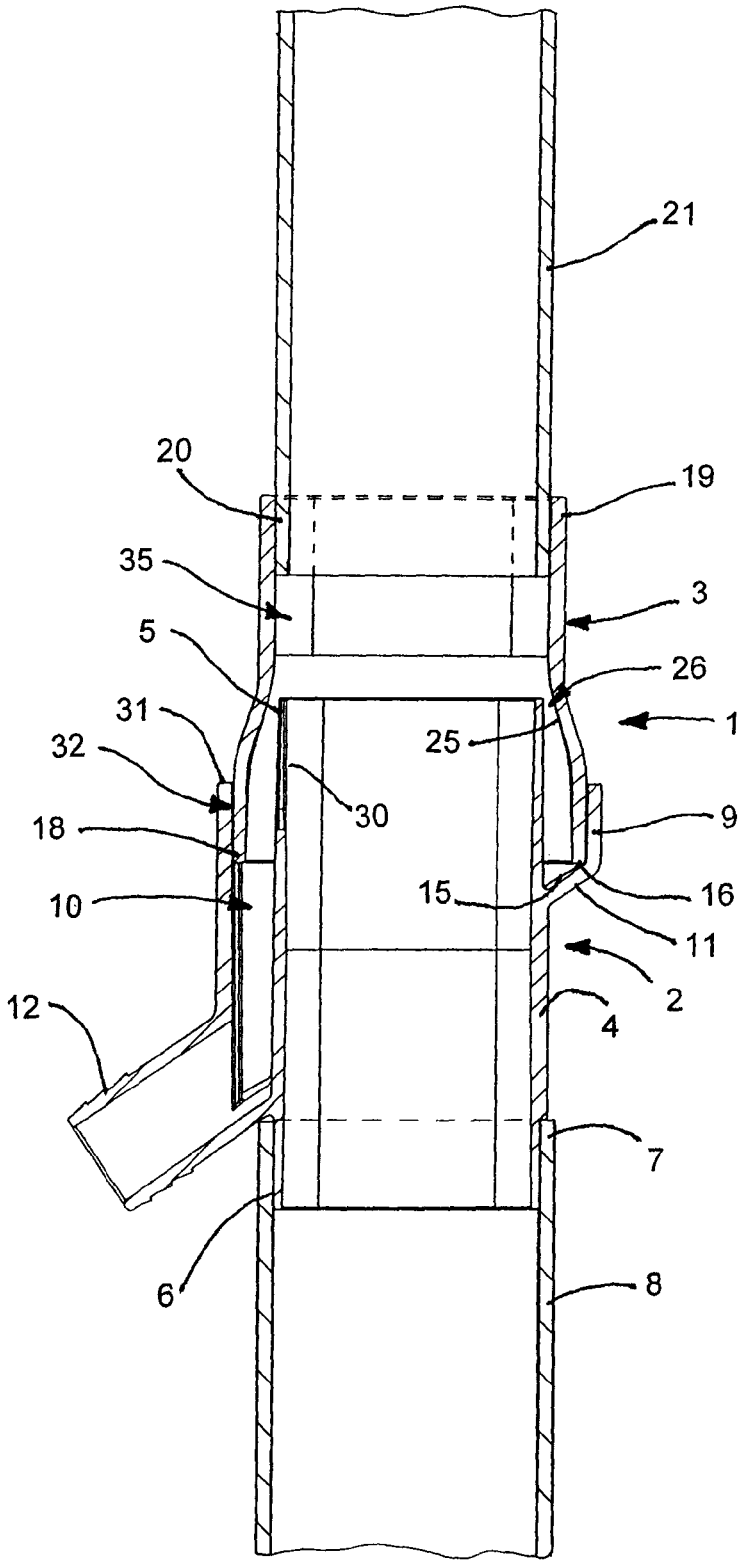
FIG. 4 is an enlarged longitudinal section through the rainwater diverter of FIG. 2, taken on the plane of the line 4-4 thereof, shown installed in line in a roof gutter downspout.
Figure 5:
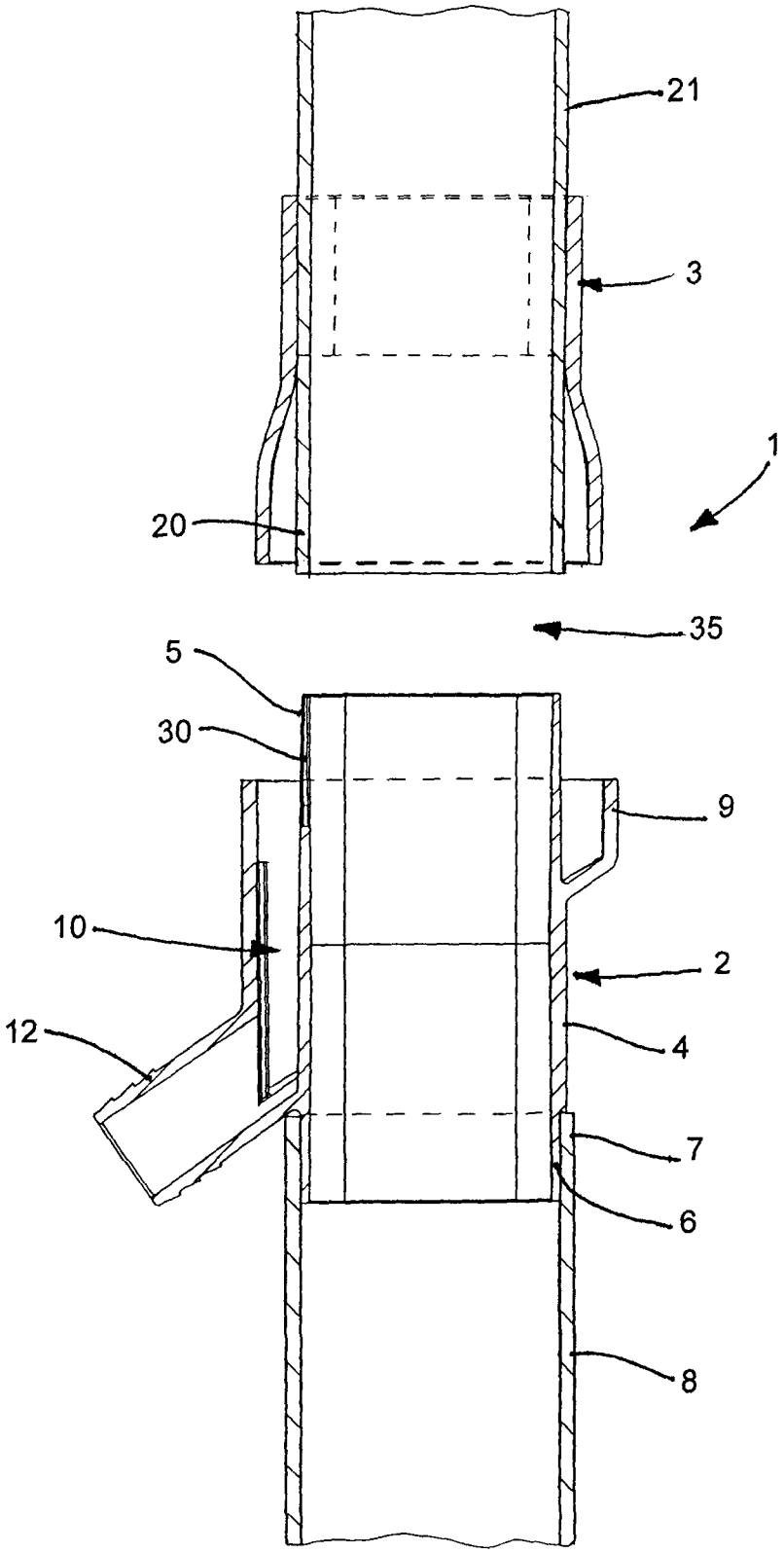
FIG. 5 is an enlarged longitudinal section through the rainwater diverter similar to FIG. 4, but showing the upper sleeve member moved up beyond the lowermost end of the upper downspout section.

Diverter 1 comprises two main components, a lower base member 2 and upper sleeve member 3, both of which may be made out of any suitable plastic material. As best seen in FIG. 4, lower base member 2 includes a generally tubular conduit 4 having upper and lower ends 5 and 6. The lower end is sized to closely fit within the upper open end 7 of a lower downspout section 8 during installation of the diverter as described hereafter.

Surrounding tubular conduit 4 in spaced relation therefrom is an outer wall 9 that provides an annular chamber 10 therebetween. Chamber 10 has a bottom wall 11 integral with tubular conduit 4 that slopes downwardly from one end of the conduit to the other along opposite sides thereof for directing diverted rainwater to a downwardly angled spout 12 adjacent the bottom of the chamber.

Outer wall 9 terminates below the upper end 5 of tubular conduit 4. Adjacent the bottom of the shallowest portion 15 of annular chamber 10 is an internal stop shoulder 16 that may extend substantially all the way around the inner wall of the chamber to provide a seat for engagement by the lowermost end 18 of upper sleeve member 3 when inserted into the upper end of the chamber as shown in FIG. 4. Lowermost end 18 is sized to have a close sliding fit inside the upper end of chamber 10.

The upper end 19 of upper sleeve member 3 is sized to have a close sliding fit over the lower end 20 of an upper downspout section 21 which is spaced from the upper end of the lower downspout section 8 when a section of the downspout is cut out prior to installation of the diverter.

Intermediate the length of upper sleeve member 3, the radial inner wall 25 thereof angles radially outwardly and axially downwardly relative to the longitudinal axis of the sleeve member around and in close proximity to the uppermost end 5 of tubular conduit 4 of the base member when the lowermost end 18 of the sleeve member is fully seated inside annular chamber 10 as shown in FIG. 4 to provide a narrow gap 26, a fraction of an inch wide, leading into the surrounding chamber. The purpose of gap 26 is to allow the rainwater, which generally adheres to the inside walls of the upper downspout section 21 and upper sleeve member 3 as it flows therethrough, to pass through the gap 26 into diverter chamber 10 and out spout 12 at the bottom of the chamber. A hose (not shown) may be connected to the spout for directing the water wherever desired. Most leaves or other debris carried by the rainwater are too large to pass through the gap and will fall down through the tubular conduit 4 into the lower downspout section 8. If desired, filter materials of any suitable type may be placed in chamber 10 to partially filter out finer materials carried by the rainwater and/or to neutralize acid levels of the water.

Figure 3:
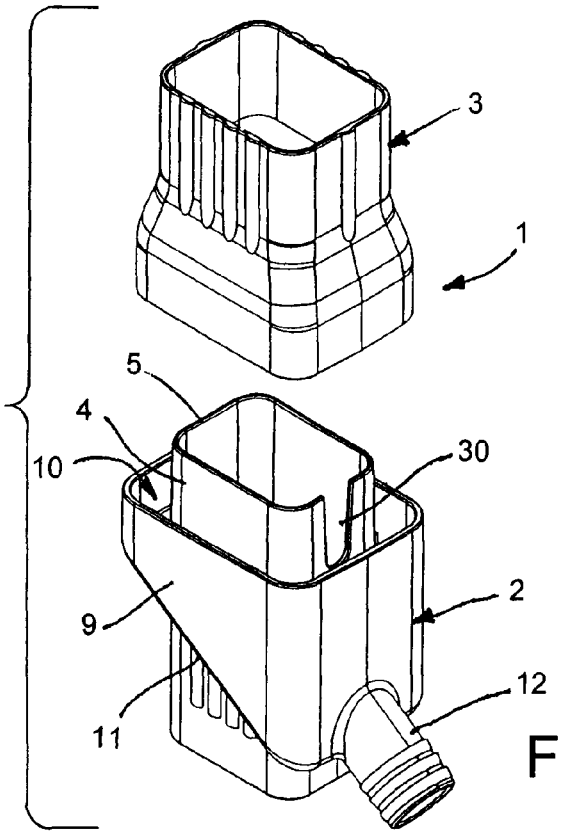
FIG. 3 is an exploded perspective view of the two main components of the rainwater diverter of FIG. 1.

Should the rainwater flowing through the downspout be greater than can be diverted by the diverter, or if the tank or other reservoir to which the diverter spout 12 is connected is completely full, or if a plug (not shown) is inserted into the diverter spout to close off the diverter, once the diverter chamber 10 is full, the flow will be redirected into the upper open end 5 of tubular conduit 4 for flow through the lower downspout section, as in a conventional downspout. However, preferably one or more slots 30 (see FIGS. 3 and 4) are provided in the upper end of tubular conduit 4 to divert any overflow from diverter chamber 10 into the tubular conduit through the slots before the overflow reaches the top of the diverter chamber. By extending the slots 30 downwardly below the uppermost end 31 of the joint/seam 32 between upper sleeve member 3 and lower base member 2 as shown in FIG. 4, any overflow from the diverter chamber will be redirected back into the tubular conduit rather than out through the joint/seam.

To install the rainwater diverter 1 in an existing gutter downspout, a portion of the gutter downspout where the diverter is to be installed must first be cut away. The length of the cut out area 35 should be somewhat less than the overall length of the diverter when assembled such that when the lower end of the base portion 2 is properly connected to the upper end of the lower downspout section 8, the upper end of the upper sleeve member 3 will extend over the lower end of the upper downspout section 21 a sufficient distance, for example one to two inches, to provide adequate support for the diverter placed between the two downspout sections.

During installation, before inserting the lower base member 2 into the cut out area 35, the upper sleeve member 3 is inserted therein and slid all the way up over the lower end of the upper downspout section 21 as shown in FIG. 4 to provide sufficient clearance space to enable the lower end 6 of the tubular conduit 4 of the lower base member to be inserted into the upper end 7 of the lower conduit section 8 as also shown in FIG. 4. Thereafter the upper sleeve member 3 may be slid down along the lower end of the upper downspout section until the lower end 18 of the upper sleeve member is properly seated against the stop shoulder 16 inside the diverter chamber to set the gap 26 leading into the diverter chamber as shown in FIG. 4.

If during use the diverter 1 should become clogged with debris, the diverter can easily be cleaned simply by sliding the upper sleeve member 3 up along the upper downspout section 21 to gain access to the interior of the lower base member 2 for clearing out the debris, with or without removing the lower base member from the lower downspout section.

Although the invention has been shown and described with respect to a certain embodiment, it is obvious that equivalent alterations and modifications will occur to others skilled in the art upon the reading and understanding of the specification. In particular, with regard to the various functions performed by the above-described components, the terms used to describe such components are intended to correspond, unless otherwise indicated, to any component which performs the specified function of the described component (e.g., that is functionally equivalent), even though not structurally equivalent to the disclosed component which performs the function of the herein illustrated exemplary embodiment of the invention. In addition, while a particular feature of the invention may have been disclosed with respect to only one embodiment, such feature may be combined with one or more other features as may be desired and advantageous for any given or particular application.

What is claimed is:

1. A rainwater diverter for diverting rainwater flowing through a roof gutter downspout, the diverter comprising a base member and a sleeve member, the base member including a tubular conduit having a lower end sized to closely fit an upper end of a lower downspout section, a fluid chamber surrounding the tubular conduit having an open upper end and a closed bottom, and a discharge opening adjacent the bottom, and the sleeve member including a lower end sized to have a close sliding fit inside the open upper end of the chamber, and an upper end sized to have a close sliding fit over a lower end of an upper downspout portion, wherein the sleeve member has a radial inner wall portion that angles radially outwardly and axially downwardly relative to a longitudinal axis of the sleeve member around a radial outer surface of an uppermost end of the tubular conduit and in close proximity to the tubular conduit to provide a narrow annular gap between the radially outwardly and axially downwardly angled radial inner wall portion of the sleeve member and the uppermost end of the tubular conduit leading into the chamber surrounding the tubular conduit for flow of at least a portion of the rainwater entering the sleeve member through the upper downspout portion into the chamber through the gap, wherein the bottom of the chamber slopes downwardly at an angle between opposite sides of the chamber outwardly of all sides of the tubular conduit toward the discharge opening for directing diverted drain water in the chamber to the discharge opening.

2. The diverter of 1 wherein the discharge opening comprises a downwardly angled spout.

3. A rainwater diverter for diverting rainwater flowing through a roof gutter downspout, the diverter comprising a base member and a sleeve member, the base member including a tubular conduit having a lower end sized to closely fit an upper end of a lower downspout section, a fluid chamber surrounding the tubular conduit having an open upper end and a closed bottom, and a discharge opening adjacent the bottom, and the sleeve member including a lower end sized to have a close sliding fit inside the open upper end of the chamber, and an upper end sized to have a close sliding fit over a lower end of an upper downspout portion, wherein the sleeve member has a radial inner wall portion that angles radially outwardly and axially downwardly relative to a longitudinal axis of the sleeve member around a radial outer surface of an uppermost end of the tubular conduit and in close proximity to the tubular conduit to provide a narrow annular gap between the radially outwardly and axially downwardly angled radial inner wall portion of the sleeve member and the uppermost end of the tubular conduit leading into the chamber surrounding the tubular conduit for flow of at least a portion of the rainwater entering the sleeve member through the upper downspout portion into the chamber through the gap, wherein the chamber is formed by an outer wall surrounding the tubular conduit in spaced relation from the tubular conduit.

4. A rainwater diverter for diverting rainwater flowing through a roof gutter downspout, the diverter comprising a base member and a sleeve member, the base member including a tubular conduit having a lower end sized to closely fit an upper end of a lower downspout section, a fluid chamber surrounding the tubular conduit having an open upper end and a closed bottom, and a discharge opening adjacent the bottom, and the sleeve member including a lower end sized to have a close sliding fit inside the open upper end of the chamber, and an upper end sized to have a close sliding fit over a lower end of an upper downspout portion, wherein the sleeve member has a radial inner wall portion that angles radially outwardly and axially downwardly relative to a longitudinal axis of the sleeve member around a radial outer surface of an uppermost end of the tubular conduit and in close proximity to the tubular conduit to provide a narrow annular gap between the radially outwardly and axially downwardly angled radial inner wall portion of the sleeve member and the uppermost end of the tubular conduit leading into the chamber surrounding the tubular conduit for flow of at least a portion of the rainwater entering the sleeve member through the upper downspout portion into the chamber through the gap, wherein the upper end of the tubular conduit extends upwardly above the open upper end of the chamber, and there is at least one slot in the upper end of the tubular conduit that extends downwardly from above the open upper end of the chamber to below the open upper end of the chamber for redirecting any rainwater overflow from the chamber through the at least one slot into the tubular conduit.

5. A rainwater diverter for diverting rainwater flowing through a roof gutter downspout, the diverter comprising a base member and a sleeve member, the base member including a tubular conduit having an upper end and a lower end sized to closely fit an upper end of a lower downspout section, an outer wall surrounding the tubular conduit in spaced relation from the tubular conduit providing a fluid chamber surrounding the tubular conduit, the chamber having an open upper end and a closed bottom, and a discharge opening adjacent the bottom, and the sleeve member including a lower end having a close sliding fit inside the open upper end of the chamber, and an upper end sized to have a close sliding fit over a lower end of an upper downspout portion, wherein the chamber has an internal shoulder for seated engagement by the lower end of the sleeve member, and the sleeve member is shaped to provide a narrow annular gap leading into the chamber between a radial inner wall portion of the sleeve member and an uppermost end of the tubular conduit when the lower end of the sleeve member is in seated engagement with the internal shoulder for flow of at least a portion of the rainwater entering the sleeve member through the upper downspout portion into the chamber through the gap, and wherein the radial inner wall portion of the sleeve member angles radially outwardly and axially downwardly relative to a longitudinal axis of the sleeve member around a radial outer surface of the uppermost end of the tubular conduit and in close proximity to the tubular conduit to provide the narrow annular gap between the sleeve member and the tubular conduit, wherein the bottom of the chamber is integral with the tubular conduit and the outer wall, and wherein the bottom of the chamber slopes downwardly at an angle between opposite sides of the chamber outwardly of all sides of the tubular conduit toward the discharge opening for directing diverted rainwater flowing through the chamber to the discharge opening.

6. The diverter of 5 wherein the discharge opening comprises a downwardly angled spout.

7. A rainwater diverter for diverting rainwater flowing through a roof gutter downspout, the diverter comprising a base member and a sleeve member, the base member including a tubular conduit having an upper end and a lower end sized to closely fit an upper end of a lower downspout section, an outer wall surrounding the tubular conduit in spaced relation from the tubular conduit providing a fluid chamber surrounding the tubular conduit, the chamber having an open upper end and a closed bottom, and a discharge opening adjacent the bottom, and the sleeve member including a lower end having a close sliding fit inside the open upper end of the chamber, and an upper end sized to have a close sliding fit over a lower end of an upper downspout portion, wherein the chamber has an internal shoulder for seated engagement by the lower end of the sleeve member, and the sleeve member is shaped to provide a narrow annular gap leading into the chamber between an inner wall portion of the sleeve member and an uppermost end of the tubular conduit when the lower end of the sleeve member is in seated engagement with the internal shoulder for flow of at least a portion of the rainwater entering the sleeve member through the upper downspout portion into the chamber through the gap, and wherein the upper end of the tubular conduit extends upwardly above the open upper end of the chamber.

8. The diverter of 7 wherein there is at least one slot in the upper end of the tubular conduit that extends downwardly from above the open upper end of the chamber to below the open upper end of the chamber for redirecting any rainwater overflow from the chamber through the at least one slot into the tubular conduit.

* * * * *